US010731824B2

(12) United States Patent
Kawai et al.

(10) Patent No.: US 10,731,824 B2
(45) Date of Patent: Aug. 4, 2020

(54) VEHICULAR LAMP

(71) Applicant: KOITO MANUFACTURING CO., LTD., Tokyo (JP)

(72) Inventors: Hiroki Kawai, Shizuoka (JP); Kenichi Takada, Shizuoka (JP); Kazutoshi Sakurai, Shizuoka (JP); Shuhei Nozue, Shizuoka (JP); Akira Hanada, Shizuoka (JP); Akinori Matsumoto, Shizuoka (JP); Shinji Kagiyama, Shizuoka (JP); Takahiko Honda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/330,216

(22) PCT Filed: Aug. 31, 2017

(86) PCT No.: PCT/JP2017/031425

§ 371 (c)(1),
(2) Date: Mar. 4, 2019

(87) PCT Pub. No.: WO2018/043663

PCT Pub. Date: Mar. 8, 2018

(65) Prior Publication Data

US 2019/0226658 A1 Jul. 25, 2019

(30) Foreign Application Priority Data

Sep. 2, 2016 (JP) ..... 2016-172134

(51) Int. Cl.
*F21S 6/00* (2006.01)
*F21V 5/04* (2006.01)
(Continued)

(52) U.S. Cl.
CPC ..... *F21V 5/04* (2013.01); *F21S 41/143* (2018.01); *F21S 41/151* (2018.01);
(Continued)

(58) Field of Classification Search
None
See application file for complete search history.

(56) References Cited

U.S. PATENT DOCUMENTS

2003/0214815 A1 11/2003 Ishida et al.
2005/0068787 A1 3/2005 Ishida
(Continued)

FOREIGN PATENT DOCUMENTS

DE 102007052696 A1 7/2008
DE 102010021937 A1 12/2011
(Continued)

OTHER PUBLICATIONS

International Search Report issued in Application No. PCT/JP2017/031425, dated Nov. 21, 2017 (5 pages).
(Continued)

*Primary Examiner* — Vip Patel
(74) *Attorney, Agent, or Firm* — Osha Liang LLP

(57) ABSTRACT

A vehicular lamp includes a first light source that emits light for forming a first distribution pattern, a second light source that emits light for forming a second distribution pattern that is added to the first distribution pattern, and a light guide member disposed in front of the first light source. The light guide member includes a first incidence surface on which the light emitted from the first light source is incident, a total reflection surface by which a part of the light incident from the first incidence surface is totally reflected, and a first emission surface from which the light totally reflected by the total reflection surface is emitted toward the lamp front. A part of the light emitted from the second light source passes
(Continued)

through the total reflection surface and the light guide member and is emitted from the first emission surface toward the lamp front.

4 Claims, 9 Drawing Sheets

(51) Int. Cl.

| | |
|---|---|
| ***F21V 5/02*** | (2006.01) |
| ***F21S 41/43*** | (2018.01) |
| ***F21S 41/663*** | (2018.01) |
| ***F21S 41/151*** | (2018.01) |
| ***F21S 41/143*** | (2018.01) |
| ***F21S 41/20*** | (2018.01) |
| ***F21S 41/255*** | (2018.01) |
| ***F21V 5/00*** | (2018.01) |
| *F21Y 115/10* | (2016.01) |

(52) U.S. Cl.
CPC ..... *F21S 41/255* (2018.01); *F21S 41/285* (2018.01); *F21S 41/43* (2018.01); *F21S 41/663* (2018.01); *F21V 5/00* (2013.01); *F21V 5/02* (2013.01); *F21Y 2115/10* (2016.08)

(56) References Cited

U.S. PATENT DOCUMENTS

| | | | |
|---|---|---|---|
| 2006/0120094 | A1 | 6/2006 | Tsukamoto et al. |
| 2010/0226142 | A1 | 9/2010 | Brendle et al. |
| 2016/0040848 | A1 | 2/2016 | Tsukamoto |
| 2017/0130923 | A1 | 5/2017 | Nishimura et al. |
| 2017/0198877 | A1 | 7/2017 | Suwa et al. |

FOREIGN PATENT DOCUMENTS

| | | | |
|---|---|---|---|
| DE | 102010046021 | A1 | 3/2012 |
| FR | 2860280 | A1 | 4/2005 |
| JP | 2003-317514 | A | 11/2003 |
| JP | 2006-164735 | A | 6/2006 |
| JP | 2014-060102 | A | 4/2014 |
| JP | 2015-185533 | A | 10/2015 |
| JP | 2016-39110 | A | 3/2016 |
| JP | 2016-058226 | A | 4/2016 |
| WO | 2016/006138 | A1 | 1/2016 |

OTHER PUBLICATIONS

Written Opinion issued in International Application No. PCT/JP2017/031425, dated Nov. 21, 2017 (4 pages).
Office Action issued in Korean Application No. 10-2019-7006223., dated Jan. 31, 2020 (11 pages).
Extended European Search Report issued in European Application No. 17846667.8, dated May 27, 2020 (7 pages).

VEHICULAR LAMP

CROSS-REFERENCE TO RELATED APPLICATIONS

The present application is a national stage application of PCT Application No. PCT/JP2017/031425 filed Aug. 31, 2017, and claims priority to Japanese Patent Application No. 2016-172134 filed on Sep. 2, 2016, the contents of which are incorporated herein by reference in their entirety.

TECHNICAL FIELD

The present invention relates to a vehicular lamp.

RELATED ART

For example, a vehicular lamp has a projector type optical system using a single projection lens and can selectively perform low beam irradiation and high beam irradiation (refer to Patent Document 1).

[Patent Document 1] JP-A-2006-164735

SUMMARY OF INVENTION

In the lamp of Patent Document 1, when irradiating a high beam, an additional light distribution pattern for high beam is added to a light distribution pattern for low beam. However, in the configuration of the lamp of Patent Document 1, when irradiating the high beam, a dark part may be generated between the light distribution pattern for low beam and the additional light distribution pattern for high beam. When the dark part is generated, a driver feels discomfort.

Accordingly, one or more embodiments of the present invention provides a vehicular lamp capable of reducing driver's discomfort, which is caused due to a dark part generated between light distribution patterns.

A vehicular lamp according to one or more embodiments of the present invention includes: a first light source configured to emit light for forming a first light distribution pattern; a second light source configured to emit light for forming a second light distribution pattern that is added to the first light distribution pattern, and a first light guide member disposed to a lamp front relative to the first light source, wherein the first light guide member has a first incidence surface portion on which the light emitted from the first light source is incident, a total reflection surface portion by which at least a part of the light incident from the first incidence surface portion into the first light guide member is totally reflected, and a first emission surface portion from which the light totally reflected by the total reflection surface portion is emitted toward the lamp front, and wherein at least a part of the light emitted from the second light source passes through the total reflection surface portion, pass through an inside of the first light guide member and is emitted from the first emission surface portion toward the lamp front.

According to the above configuration, at least a part of the light emitted from the second light source is emitted from the first emission surface portion, from which the light for forming the first light distribution pattern is emitted, toward the lamp front. Since the light is guided so as to form an overlapping part between the first light distribution pattern and the second light distribution pattern, a dark part is less likely to be generated between the first light distribution pattern and the second light distribution pattern. For this reason, it is possible to reduce driver's discomfort that is caused due to the dark part.

In the vehicular lamp according to one or more embodiments of the present invention, the first light guide member may include an inclined surface that is inclined from the first light source-side toward the second light source-side as proceeding toward the lamp front, and the total reflection surface portion may be included in the inclined surface.

According to the above configuration, it is possible to make a part of the light, which is to be emitted from the second light source, be incident on the total reflection surface portion at an angle at which the light can easily pass through the total reflection surface portion.

The vehicular lamp according to one or more embodiments of the present invention may further include a second light guide member disposed to the lamp front relative to the second light source, and the second light guide member may include a second incidence surface portion on which the light emitted from the second light source is incident, a second emission surface portion from which at least a part of the light incident from the second incidence surface portion into the second light guide member is emitted toward the lamp front, and a third emission surface portion from which at least a part of the light incident from the second incidence surface portion into the second light guide member is emitted toward the total reflection surface portion of the first light guide member.

According to the above configuration, it is possible to efficiently distribute the light emitted from the second light source into light traveling toward the second emission surface portion and light traveling toward the third emission surface portion.

In the vehicular lamp according to one or more embodiments of the present invention, the total reflection surface portion of the first light guide member and the third emission surface portion of the second light guide member may be disposed in parallel with a predetermined interval.

According to the above configuration, it is possible to make the light, which is emitted from the third emission surface portion, be incident on the total reflection surface portion at an angle at which the light can easily pass through the total reflection surface portion.

The vehicular lamp according to one or more embodiments of the present invention may further include a projection lens, the first light source and the second light source may be disposed at the rear of the projection lens, the first light distribution pattern may be a light distribution pattern for low beam, the second light distribution pattern may be an additional light distribution pattern for high beam, the vehicular lamp may be configured to selectively perform low beam irradiation and high beam irradiation, and a boundary between the total reflection surface portion and the first emission surface portion may be a cutoff line forming portion.

According to the above configuration, a dark part is less likely to be generated between the first light distribution pattern for low beam and the second light distribution pattern for high beam. For this reason, when a driver switches between the low beam irradiation and the high beam irradiation, it is possible to reduce driver's discomfort that is caused due to the dark part.

According to the vehicular lamp according to one or more embodiments of the present invention, it is possible to reduce driver's discomfort that is caused due to the dark part generated between the respective light distribution patterns.

DETAILED DESCRIPTION

Hereinafter, embodiments of the present embodiment will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
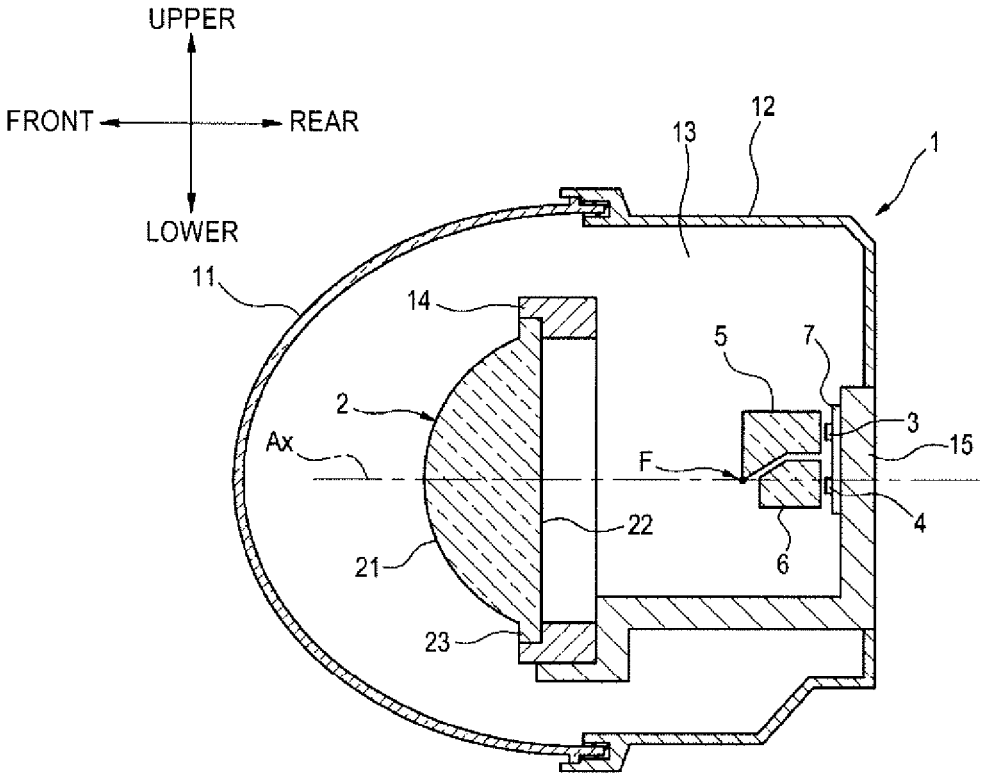
FIG. 1 is a longitudinal sectional view of a vehicular lamp in accordance with one or more embodiments of the present invention.

As shown in FIG. 1, a vehicular lamp 1 includes a projection lens 2, a first light source 3 and a second light source 4 disposed at the rear of the projection lens, and a first light guide lens 5 (an example of the first light guide member) and a second light guide lens 6 (an example of the second light guide member) disposed between the projection lens 2 and the light sources (the first light source 3 and the second light source 4).

The respective members are accommodated in a lamp chamber 13 defined by an outer lens 11 and a housing 12. Also, the projection lens 2 is supported at an outer periphery flange portion 23 thereof to a lens holder 14. The first light source 3 and the second light source 4 are attached on a substrate 7. The first light guide lens 5, the second light guide lens 6, the substrate 7 and the lens holder 14 are attached to a base member 15.

The vehicular lamp 1 of the present example is a headlamp capable of selectively performing low beam irradiation and high beam irradiation and is configured as a projector-type lamp unit.

The projection lens 2 is a piano-convex aspherical lens of which a front surface 21 is a convex surface and a rear surface 22 is a planar surface, and has an optical axis Ax extending in a front and rear direction of a vehicle. A rear focus F of the projection lens 2 is located on the optical axis Ax, and a light source image that is formed on a rear focal plane, which is a focal plane including the rear focus F, is projected on the virtual vertical screen of the lamp front, as a reverted image. In the present example, the virtual vertical screen is arranged, for example, at a position of 25 m ahead of the vehicle.

The first light source 3 is disposed above the optical axis Ax at the rear of the rear focus F of the projection lens 2. The first light source 3 is configured, for example, by a white light-emitting diode, and has a rectangular light-emitting surface that is long vertically. The first light source 3 is attached on the substrate 7 having a circuit wiring, in a state where the light-emitting surface thereof faces toward the lamp front. The light emitted from the first light source 3 is mainly incident on a region, which is below the optical axis Ax, of the rear surface (incidence surface) 22 of the projection lens 2, and is emitted from the front surface (emission surface) 21, thereby forming a light distribution pattern for low beam (an example of the first light distribution pattern).

The second light source 4 is disposed above the optical axis Ax or slightly below the optical axis Ax at the rear of the rear focus F of the projection lens 2. The second light source 4 is configured, for example, by a white light-emitting diode, and has a rectangular light-emitting surface that is long vertically. The second light source 4 is attached on the substrate 7, which is the same as the substrate having the first light source 3 attached thereon, in a state where the light-emitting surface thereof faces toward the lamp front. The light emitted from the second light source 4 is incident on a substantially entire region of the incidence surface 22 of the projection lens 2, and is emitted from the emission surface 21, thereby forming an additional light distribution pattern for high beam (an example of the second light distribution pattern) that is added to the light distribution pattern for low beam.

In the present example, the "light distribution pattern for low beam" and the "additional light distribution pattern for high beam", which will be described later, mean light distribution patterns to be formed on the virtual vertical screen arranged at a position of 25 m ahead of the vehicle, for example. The description "between the light distribution pattern for low beam and the additional light distribution pattern for high beam" means between both the light distribution patterns to be formed on the virtual vertical screen.

Figure 2:
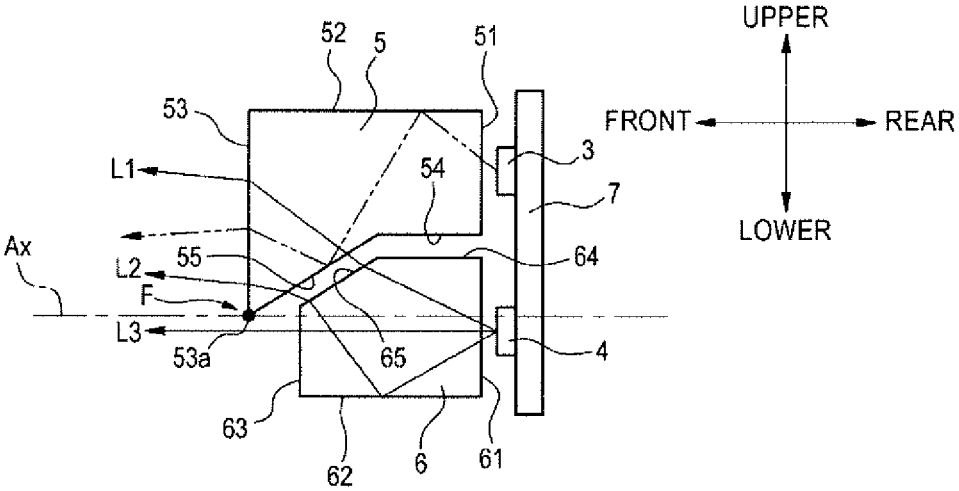
FIG. 2 is an enlarged view depicting a light source and a light guide lens of the vehicular lamp.

FIG. 2 depicts the first light source 3 and the second light source 4 attached on the substrate 7, and the first light guide lens 5 and the second light guide lens 6 disposed in front of the light sources.

As shown in FIG. 2, the first light guide lens 5 is disposed in front of the first light source 3. The first light guide lens 5 has a first incidence surface portion 51 on which the light emitted from the first light source 3 is incident. The first incidence surface portion 51 is provided to face the light-emitting surface of the first light source 3 and to extend in a direction (an upper and lower direction) perpendicular to the optical axis Ax.

Also, the first light guide lens 5 has an upper surface portion 52 extending in parallel with the optical axis Ax forward from an upper end edge of the first incidence surface portion 51, and a first emission surface portion 53 extending in parallel with the first incidence surface portion 51 downward from a front end edge of the upper surface portion 52. The first emission surface portion 53 is formed to have such a length that a lower end edge 53*a* overlaps the rear focus F on the optical axis Ax. From the first emission surface portion 53, the light of the first light source 3 incident into the first light guide lens 5 is emitted toward the lamp front.

Also, the first light guide lens 5 has a lower surface portion 54 extending in parallel with the optical axis Ax forward from a lower end edge of the first incidence surface portion 51, and a total reflection surface portion 55 extending from a front end edge of the lower surface portion 54 to the lower end edge 53*a* of the first emission surface portion 53. The lower surface portion 54 is formed to be shorter than the facing upper surface portion 52 in the front and rear direction. The total reflection surface portion 55 is inclined downward from the front end edge of the lower surface portion 54 toward the lower end edge 53*a* of the first emission surface portion 53. That is, the total reflection surface portion 55 is configured as an inclined surface that is inclined from the first light source 3 toward the second light source 4 as proceeding toward the lamp front. The total reflection surface portion 55 is formed to have an inclination angle at which the light of the first light source 3 incident from the first incidence surface portion 51 into the first light guide lens 5 and reaching the total reflection surface portion 55 is totally reflected. The light totally reflected on the total reflection surface portion 55 is emitted from the first emission surface portion 53 toward the lamp front.

The second light guide lens 6 is disposed in front of the second light source 4. The second light guide lens 6 has a second incidence surface portion 61 on which the light emitted from the second light source 4 is incident. The second incidence surface portion 61 is disposed to face the light-emitting surface of the second light source 4 and to traverse the optical axis Ax in the direction (the upper and lower direction) perpendicular to the optical axis Ax.

Also, the second light guide lens 6 has a lower surface portion 62 extending in parallel with the optical axis Ax forward from a lower end edge of the second incidence surface portion 61 and a second emission surface portion 63 extending in parallel with the second incidence surface portion 61 upward from a front end edge of the lower surface portion 62. The second emission surface portion 63 is formed to be shorter than the facing second incidence surface portion 61 in the upper and lower direction. The second emission surface portion 63 is configured to emit at least a part of the light of the second light source 4 incident into the second light guide lens 6 toward the lamp front.

Also, the second light guide lens 6 has an upper surface portion 64 extending in parallel with the optical axis Ax forward from an upper end edge of the second incidence surface portion 61, and a third emission surface portion 65 extending from a front end edge of the upper surface portion 64 to an upper end edge of the second emission surface portion 63. The upper surface portion 64 is formed to be shorter than the facing lower surface portion 62 in the front and rear direction. The third emission surface portion 65 is configured as an inclined surface that is inclined downward from the front end edge of the upper surface portion 64 toward the upper end edge of the second emission surface portion 63. The third emission surface portion 65 is inclined to be in parallel with the total reflection surface portion 55 of the first light guide lens 5 with a predetermined interval therebetween. Also, the upper surface portion 64 is formed to be in parallel with the lower surface portion 54 of the first light guide lens 5 with a predetermined interval therebetween. The third emission surface portion 65 is configured to emit at least a part of the light of the second light source 4 incident from the second incidence surface portion 61 into the second light guide lens 6 toward the total reflection surface portion 55 of the first light guide lens 5. The lights L1, L2 of the second light source 4 emitted from the third emission surface portion 65 are incident into the first light guide lens 5 through the total reflection surface portion 55, pass through an inside of the first light guide lens 5 and are then emitted from the first emission surface portion 53 toward the lamp front.

Figure 3:
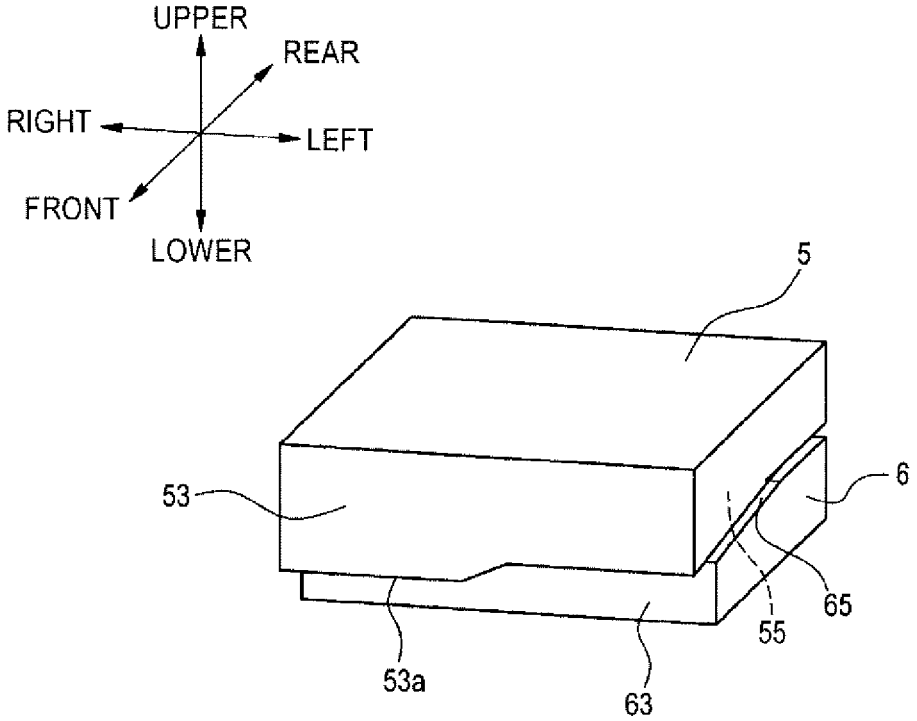
FIG. 3 is a perspective view of the light guide lens, as seen from above.

FIG. 3 is a perspective view depicting the first light guide lens 5 and the second light guide lens 6. The first light guide lens 5 and the second light guide lens 6 have a square pillar shape that is laterally long, respectively, and are formed of transparent resin, transparent glass or the like, for example. As shown in FIGS. 2 and 3, the first light guide lens 5 is disposed above the second light guide lens 6 with a predetermined gap. A front end portion of the first light guide lens 5 is arranged to protrude more forward than the second emission surface portion 63 of the second light guide lens 6. The lower end edge 53*a* of the first emission surface portion 53 of the first light guide lens 5 extends horizontally in different levels on left and right sides. The lower end edge 53*a*, which is a boundary between the total reflection surface portion 55 and the first emission surface portion 53 of the first light guide lens 5, is configured as a cutoff line forming portion for forming a shape of a cutoff line of the light distribution pattern for low beam.

Figure 4:
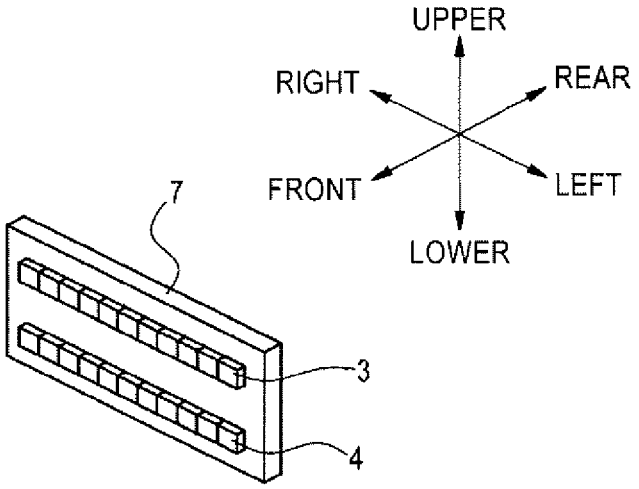
FIG. 4 is a perspective view depicting an example of the light source that is used for the vehicular lamp.

As shown in FIG. 4, the first light source 3 and the second light source 4 each of which includes a plurality of (eleven, in the present example) light-emitting elements (for example, LEDs) aligned in parallel in the right and left direction are disposed with being attached on the substrate 7 at the rear of the first light guide lens 5 and the second light guide lens 6. The respective light-emitting elements are disposed with equal intervals in the right and left direction about positions immediately below the optical axis Ax, and are configured to be individually turned on and off by a lighting control circuit (not shown) provided on the substrate 7.

Figure 5:
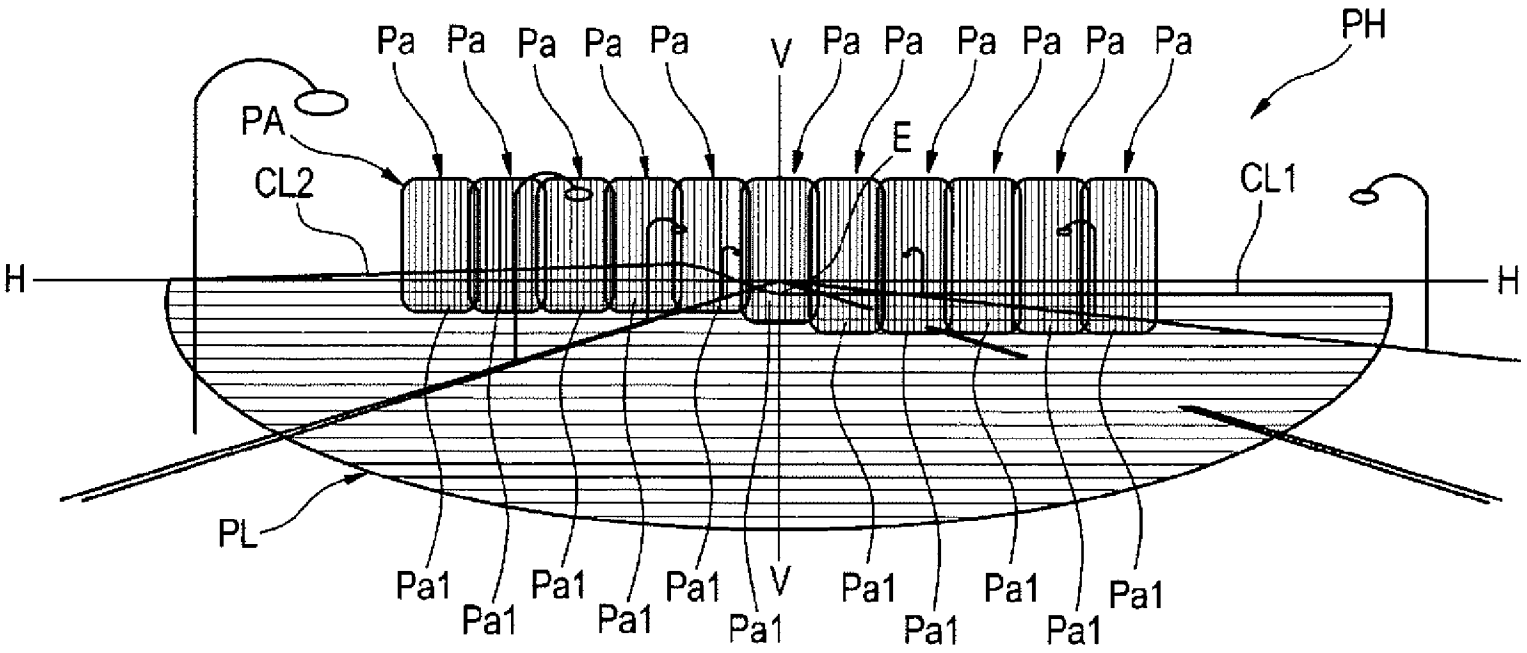
FIG. 5 is a view perspectively depicting a light distribution pattern that is formed on a virtual vertical screen disposed to the lamp front by light irradiated from the vehicular lamp.

FIG. 5 is a view perspectively depicting a light distribution pattern PH for high beam that is formed on the virtual vertical screen arranged at a position of 25 m ahead of the vehicle by the light irradiated forward from the vehicular lamp 1. The light distribution pattern PH for high beam is formed as a combined light distribution pattern of a light distribution pattern PL for low beam and an additional light distribution pattern PA for high beam.

The light distribution pattern PL for low beam is a light distribution pattern for low beam of light distribution light and has cutoff lines CL1, CL2 that differ in level on left and right sides along an upper end edge thereof. The cutoff lines CL1, CL2 extend horizontally in different levels on left and right sides of a V-V line as a boundary vertically passing H-V, which is a focus in the lamp front direction. A right oncoming vehicle lane-side portion, which lies on the right side of the V-V line, is formed as a lower cutoff line CL1, and a host vehicle lane-side portion, which lines on the left side of the V-V line, is formed as an upper cutoff line CL2 that lies at an upper level than the lower cutoff line CL1 via an inclined portion.

The light distribution pattern PL for low beam is formed by projecting a light source image of the first light source 3, which is formed on the rear focal plane of the projection lens 2 by the light of the first light source 3 emitted from the first emission surface portion 53 of the first light guide lens 5, onto the virtual vertical screen by the projection lens 2, as a reverted projected image. The cutoff lines CL1, CL2 are formed as a reverted projected image of the lower end edge 53*a*, which is a boundary between the total reflection surface portion 55 and the first emission surface portion 53 of the first light guide lens 5. That is, the lower end edge 53*a* functions as a cutoff line forming portion for forming the cutoff lines CL1, CL2 of the light distribution pattern PL for low beam.

In the light distribution pattern PL for low beam, an elbow point E that is an intersection point of the lower cutoff line CL1 and the V-V line is located on the order of 0.5 to 0.6° below a cross point of the H-H line and the V-V line.

In the light distribution pattern PH for high beam, the additional light distribution pattern PA is additionally formed as a horizontally long light distribution pattern so as to expand upward from the cutoff lines CL1, CL2, so that a traveling road in front of the vehicle is widely irradiated. The additional light distribution pattern PA is formed as a combined light distribution pattern of eleven light distribution patterns Pa. Each light distribution pattern Pa is a light distribution pattern that is formed as a reverted projected image of a light source image of the light-emitting element formed on the rear focal plane of the projection lens 2 by the light emitted from each light-emitting element of the second light source 4.

Each light distribution pattern Pa has a substantially rectangular shape that is slightly long in the upper and lower direction. This corresponds to the rectangular outer shape, which is vertically long, of the light-emitting surface of each light-emitting element. Also, each light distribution pattern Pa is formed so as to slightly overlap the adjacent light distribution pattern Pa. This is because each light-emitting element is disposed at the rear of the rear focal plane of the projection lens 2 and a range of a bundle of beams passing through the rear focal plane of the projection lens 2 slightly overlaps between the light-emitting elements adjacent to each other.

Also, the respective light distribution patterns Pa are formed with lower end edges thereof coinciding with or partially overlapping the cutoff lines CL1, CL2. This is because the light of the second light source 4 emitted from the third emission surface 65 of the second light guide lens 6, incident on the total reflection surface portion 55 of the first light guide lens 5 and emitted from the first emission surface portion 53 is emitted as light deviating slightly downward (deviating toward the light distribution pattern PL for low beam) from the emission surface 21 of the projection lens 2.

Meanwhile, in a configuration where it is possible to selectively perform low beam irradiation and high beam irradiation by a projector type optical system using a single projection lens, in order to form the cutoff lines of the light distribution pattern for low beam, it is necessary to provide a member (shade) for shielding a part of the light emitted from the light source. Since a tip end of the shade is a portion that cannot reflect the light and becomes a cause of a dark part in the light distribution pattern, the tip end is preferably formed as thin as possible. However, it is impossible to physically set a thickness of the tip end to zero. For this reason, in the configuration of Patent Document 1, a dark part corresponding to a thickness of the shade is generated between the light distribution pattern for low beam and the additional light distribution pattern for high beam.

In contrast, according to the vehicular lamp 1 of the present embodiment, a part of the light emitted from the second light source 4 is emitted from the first emission surface portion 53 of the first light guide lens 5, from which the light for forming the light distribution pattern PL for low beam is emitted, toward the lamp front. Since the light is light emitted from the first emission surface portion 53, it is more likely to travel in a direction of the light distribution pattern PL for low beam than the light of the second light source 4 emitted from the second emission surface portion 63 of the second light guide lens 6 toward the projection lens 2. In particular, the light L2 of the second light source 4 emitted from a position of the first emission surface portion 53 close to the rear focus F has such a tendency. For this reason, the light of the second light source 4 emitted from the first emission surface portion 53 is guided so as to form overlapping portions Pa1 of the light distribution pattern PL for low beam and the additional light distribution pattern PA for high beam. As a result, a dark part is less likely to be generated between the light distribution pattern PL for low beam and the additional light distribution pattern PA for high beam. Thereby, it is possible to reduce driver's discomfort that is caused due to the dark part.

Also, the total reflection surface portion 55 of the first light guide lens 5 is configured as the inclined surface that is inclined from the first light source 3-side toward the second light source 4-side as proceeding toward the lamp front. For this reason, it is possible to make parts L1, L2 of the light emitted from the second light source 4 be incident on the total reflection surface portion 55 at angles at which the lights can easily pass through the total reflection surface portion 55. Therefore, it is possible to emit a part of the light emitted from the second light source 4 from the first emission surface portion 53 of the first light guide lens 5 toward the lamp front and to suppress the dark part between the light distribution patterns.

Also, the second light guide lens 6 has the second emission surface portion 63 parallel with the second incidence surface portion 61 and the third emission surface portion 65 inclined toward the first light guide lens 5. For this reason, it is possible to efficiently distribute the light emitted from the second light source 4 into light L3 traveling from the second emission surface portion 63 toward the projection lens 2 and lights L1, L2 traveling from the third emission surface portion 65 toward the total reflection surface portion 55 of the first light guide lens 5. Therefore, it is possible to emit a part of the light emitted from the second light source 4 from the first emission surface portion 53 of the first light guide lens 5 toward the lamp front and to suppress the dark part between the light distribution patterns.

Also, the total reflection surface portion 55 of the first light guide lens 5 and the third emission surface portion 65 of the second light guide lens 6 are disposed in parallel with a predetermined interval. For this reason, it is possible to make the lights L1, L2 emitted from the third emission surface portion 65 be incident on the total reflection surface portion 55 at angles at which the lights can easily pass through the total reflection surface portion 55. Therefore, it is possible to emit a part of the light emitted from the second light source 4 from the first emission surface portion 53 of the first light guide lens 5 toward the lamp front and to suppress the dark part between the light distribution patterns.

First Modified Embodiment

Subsequently, a first modified embodiment of the first light guide lens 5 and the second light guide lens 6 described in the above embodiment is described with reference to FIGS. 6 to 10. Since the parts denoted with the same reference numerals as the above embodiment have the same functions, the overlapping descriptions thereof are omitted.

Figure 6:
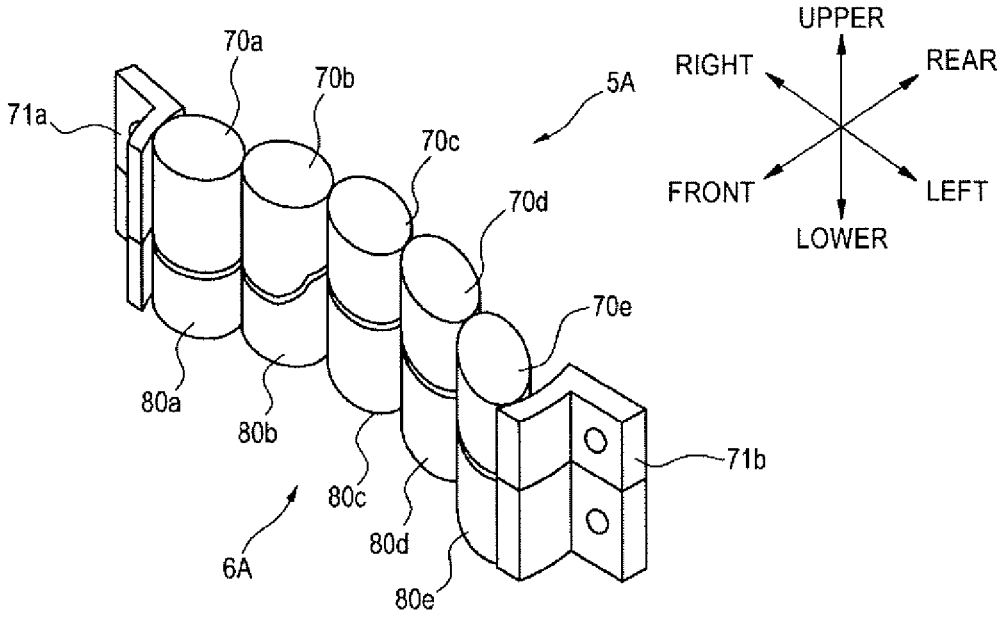
FIG. 6 is a perspective view depicting a first modified embodiment of the light guide lens.

As shown in FIG. 6, a first light guide lens 5A (an example of the first light guide member) and a second light guide lens 6A (an example of the second light guide member) of the first modified embodiment have a lens array configuration where a plurality of (five, in the present example) lenses 70*a* to 70*e*; 80*a* to 80*e* is coupled in a lateral direction (the right and left direction), respectively.

The lenses 70*a* to 70*e*, 80*a* to 80*e* are a biconvex lens of which a front surface and a rear surface are convex surfaces, respectively. The lenses 70*a* to 70*e* configuring the first light guide lens 5A are disposed with being superimposed above the lenses 80*a* to 80*e* configuring the second light guide lens 6A. The coupled lenses 70*a* to 70*e*, 80*a* to 80*e* are fixed from both sides by attachment members 71*a*, 71*b* and are attached on the base member 15.

Figure 7:
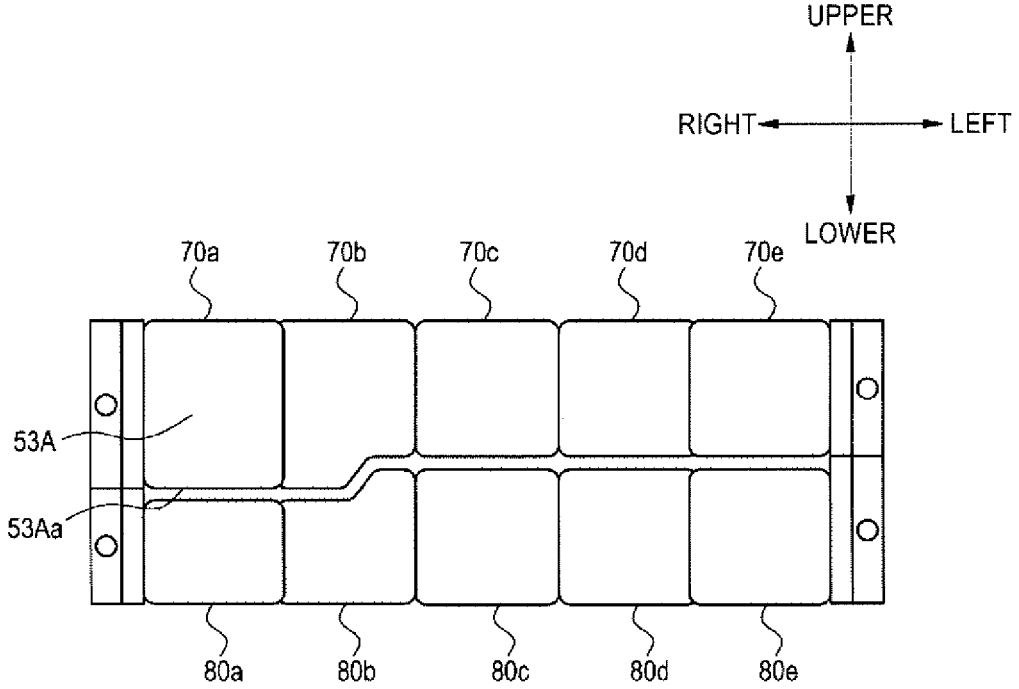
FIG. 7 is a front view of a light guide lens shown in FIG. 6.

As shown in FIG. 7, the lenses 70*a* to 70*e* and the lenses 80*a* to 80*e* are disposed with being superimposed with a predetermined interval therebetween. Also, lower end edges 53Aa of first emission surface portions (front surfaces) 53A of the lenses 70*a* to 70*e* extend horizontally in different levels on left and right sides. The lower end edges 53Aa of the lenses 70*a* to 70*e* are the cutoff line forming portion for forming a shape of the cutoff line of the light distribution pattern for low beam.

Figure 8:
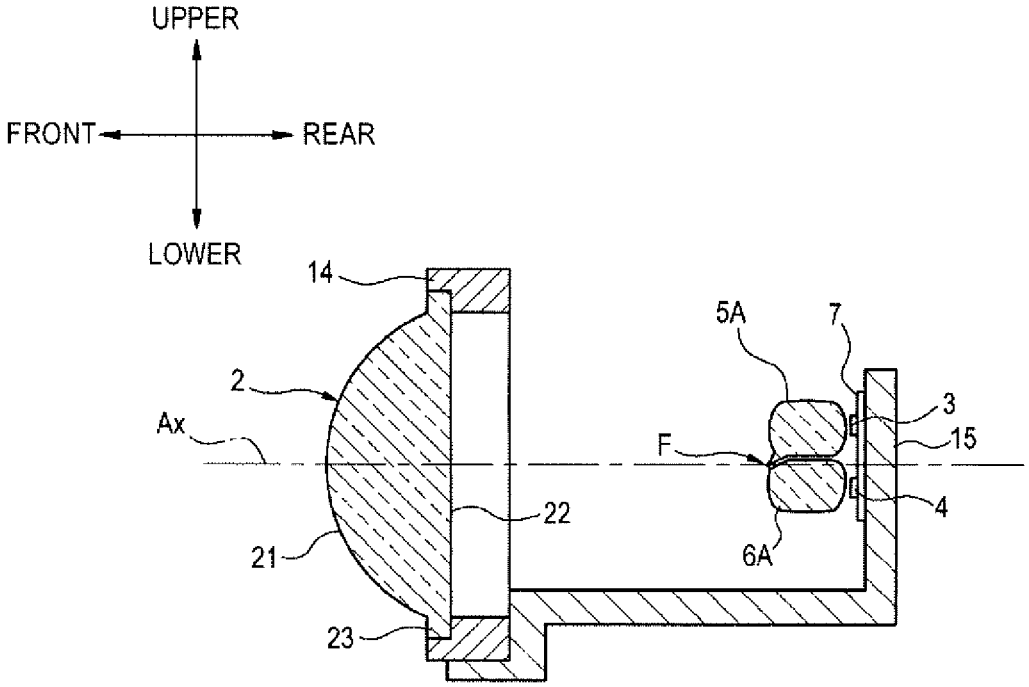
FIG. 8 is a longitudinal sectional view of the vehicular lamp using the light guide lens shown in FIG. 6.
Figure 9:
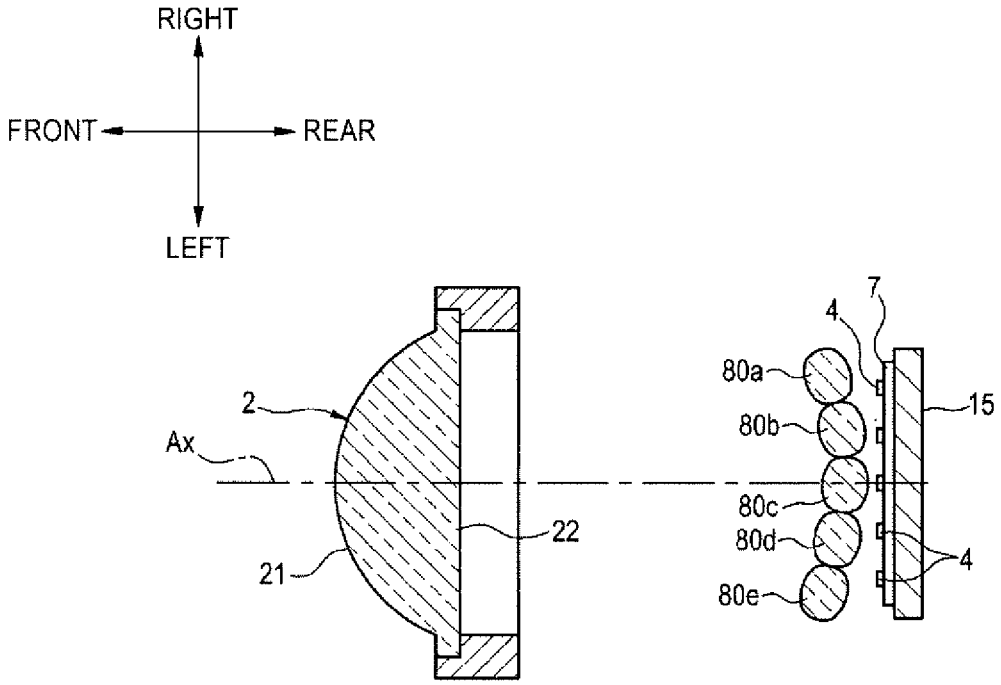
FIG. 9 is a horizontal sectional view of the vehicular lamp using the light guide lens shown in FIG. 6.

As shown in FIG. 8, the first light guide lens 5A and the second light guide lens 6A are disposed between the projection lens 2 and the light sources (the first light source 3 and the second light source 4). Also, as shown in FIG. 9, the lenses 80*a* to 80*e* configuring the second light guide lens 6A and the lenses 70*a* to 70*e* configuring the first light guide lens 5A are disposed with being coupled in a concave shape on the rear focal plane of the projection lens 2. Each of the lenses 80*a* to 80*e* is disposed in front of the plurality of (five, in the present example) second light sources 4. Likewise, each of the lenses 70*a* to 70*e* is disposed in front of the first light source 3.

Figure 10:
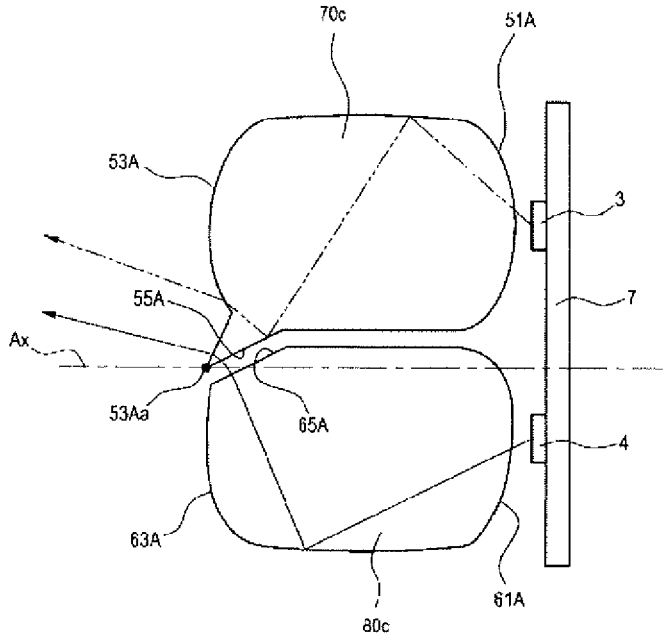
FIG. 10 is an enlarged view depicting the light source and the light guide lens shown in FIG. 8.

As shown in FIG. 10, a first incidence surface portion 51A, a first emission surface portion 53A, a lower end edge 53Aa and a total reflection surface portion 55A of each (the lens 70*c* is shown) of the lenses 70*a* to 70*e* correspond to the first incidence surface portion 51, the first emission surface portion 53, the lower end edge 53*a*, and the total reflection surface portion 55 of the first light guide lens 5 (refer to FIG. 2) of the above embodiment. Also, a second incidence surface portion 61A, a second emission surface portion 63A, and a third emission surface portion 65A of each (the lens 80*c* is shown) of the lenses 80*a* to 80*e* correspond to the second incidence surface portion 61, the second emission surface portion 63, and the third emission surface portion 65 of the second light guide lens 6 (refer to FIG. 2) of the above embodiment. The lower end edge 53Aa, which is a boundary between the total reflection surface portion 55A and the first emission surface portion 53A, is a cutoff line forming portion. A position of the first emission surface portion 53A of each of the lenses 70*a* to 70*e* in the front and rear direction and a position of the second emission surface portion 63A of each of the lenses 80*a* to 80*e* in the front and rear direction are substantially the same.

According to the above configuration, since each of the lenses (the lenses 70*a* to 70*e* and the lenses 80*a* to 80*e*) is disposed in front of each of the light sources, a light collecting degree of each light source is improved. Also, like the above embodiment, it is possible to emit a part of the light emitted from the second light source 4 from the first emission surface portion 53A of the first light guide lens 5A toward the lamp front, so that it is possible to suppress the dark part between the light distribution pattern PL for low beam and the additional light distribution pattern PA for high beam.

Second Modified Embodiment

Subsequently, a second modified embodiment of the first light guide lens 5 and the second light guide lens 6 of the above embodiment is described with reference to FIG. 11. Since the parts denoted with the same reference numerals as the above embodiment have the same functions, the overlapping descriptions thereof are omitted.

Figure 11:
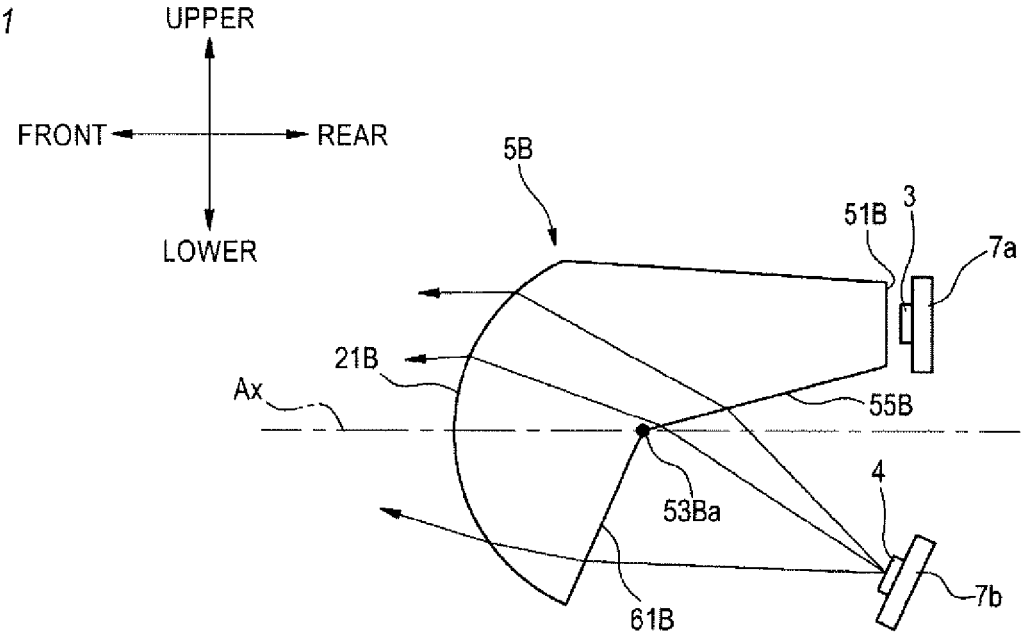
FIG. 11 is a longitudinal sectional view depicting a second modified embodiment of the light guide lens.

As shown in FIG. 11, a light guide lens 5B (an example of the first light guide member) of the second modified embodiment is configured to function not only as the first light guide lens 5 of the above embodiment on which the light of the first light source 3 is incident but also as the second light guide lens 6 of the above embodiment on which the light of the second light source 4 is incident. Also, the light guide lens 5B is configured to function as the projection lens 2.

The light guide lens 5B has a first incidence surface portion 51B, a total reflection surface portion 55B, and an edge portion 53Ba. The edge portion 53Ba corresponds to the lower end edge 53*a* of the first light guide lens 5 (refer to FIG. 2) of the above embodiment. Also, the light guide lens 5B has a second incidence surface portion 61B corresponding to the second incidence surface portion 61 of the second light guide lens 6 (refer to FIG. 2) of the above embodiment, and an emission surface 21B corresponding to the emission surface 21 of the projection lens 2. The first light source 3 is attached on a substrate 7*a* in a state where the light-emitting surface thereof faces toward the lamp front, and the second light source 4 is attached on a substrate 7*b* in a state where the light-emitting surface thereof faces obliquely in a front and upper direction.

According to the above configuration, it is possible to make a part of the light emitted from the second light source 4 be incident on the total reflection surface portion 55B of the light guide lens 5B, so that it is possible to suppress the dark part between the light distribution pattern PL for low beam and the additional light distribution pattern PA for high beam.

Third Modified Embodiment

Subsequently, a third modified embodiment of the first light guide lens 5 and the second light guide lens 6 of the above embodiment is described with reference to FIG. 12. Since the parts denoted with the same reference numerals as the above embodiment have the same functions, the overlapping descriptions thereof are omitted.

Figure 12:
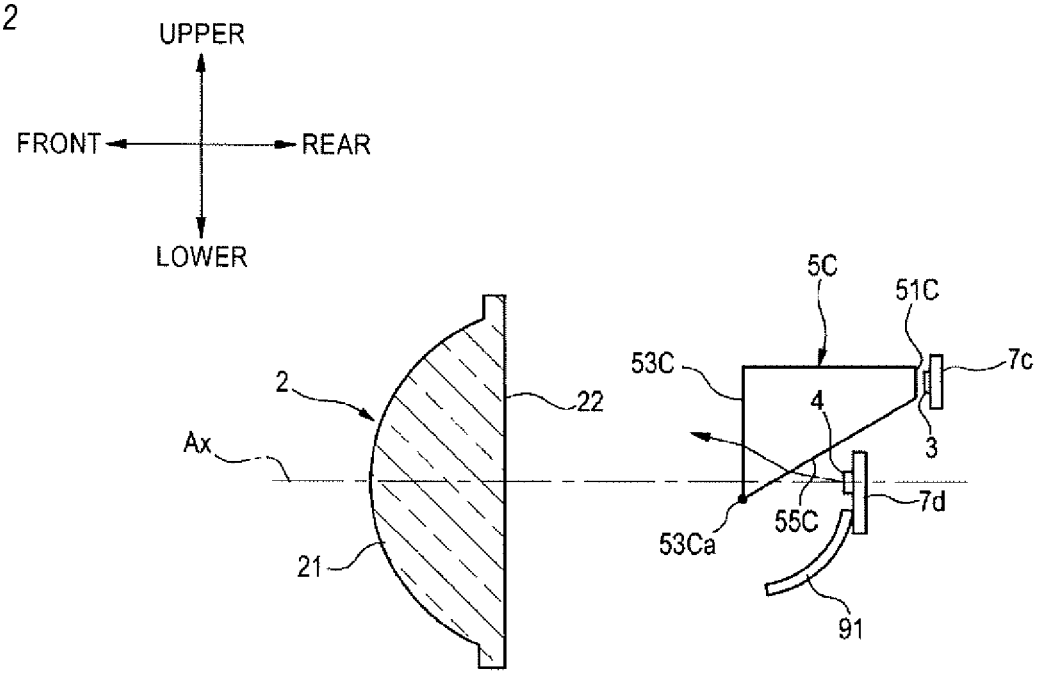
FIG. 12 is a longitudinal sectional view depicting a third modified embodiment of the light guide lens.

As shown in FIG. 12, a light guide lens 5C (an example of the first light guide member) of the third modified embodiment has a similar function to the first light guide lens 5 of the above embodiment. The light guide lens 5C has a first incidence surface portion 51C, a first emission surface portion 53C, a lower end edge 53Ca, and a total reflection surface portion 55C.

The first light source 3 and the second light source 4 are respectively attached on a substrate 7*c* and a substrate 7*d* in a state where the light-emitting surfaces thereof face toward the lamp front. A parabolic reflector 91 is attached on the substrate 7*d* of the second light source 4. The second light source 4 is disposed above the rear focal plane of the projection lens 2 in front of the first light source 3. The lower end edge 53Ca is disposed below the optical axis Ax in front of the rear focus F. In the meantime, the position of the rear focal plane may be located between the first light source 3 and the second light source 4.

According to the above configuration, since it is possible to make a part of the light emitted from the second light source 4 be incident on the total reflection surface portion 55C of the light guide lens 5C and be emitted from the first emission surface portion 53C of the light guide lens 5C toward the lamp front, it is possible to suppress the dark part between the light distribution pattern PL for low beam and the additional light distribution pattern PA for high beam.

Fourth Modified Embodiment

Subsequently, a fourth modified embodiment of the first light guide lens 5 and the second light guide lens 6 of the above embodiment is described with reference to FIG. 13. Since the parts denoted with the same reference numerals as the above embodiment have the same functions, the overlapping descriptions thereof are omitted.

Figure 13:
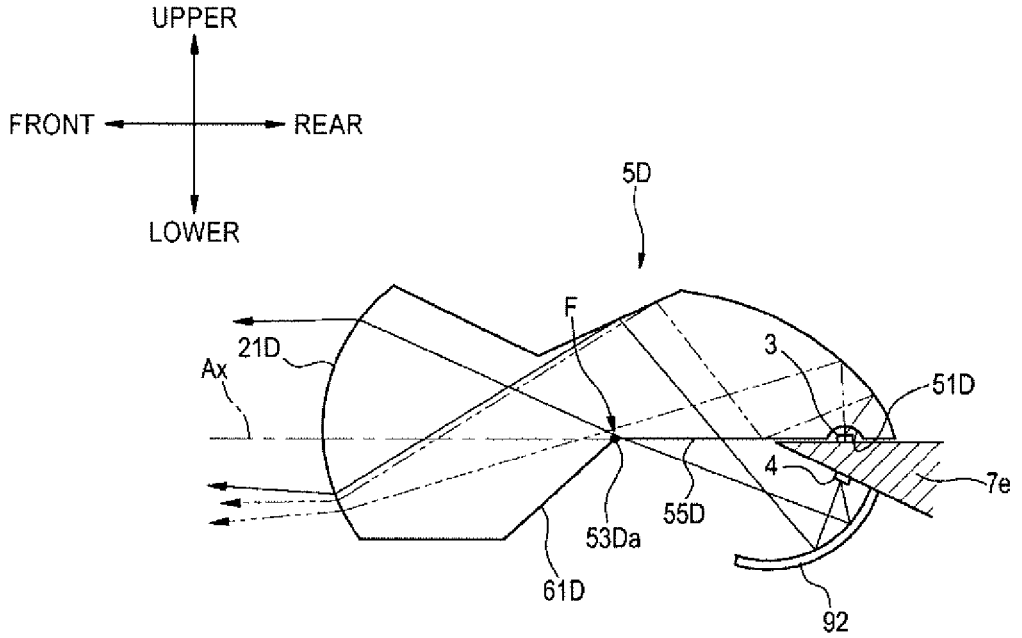
FIG. 13 is a longitudinal sectional view depicting a fourth modified embodiment of the light guide lens.

As shown in FIG. 13, a light guide lens 5D (an example of the first light guide member) of the fourth modified embodiment is configured to function not only as the first light guide lens 5 of the above embodiment on which the light of the first light source 3 is incident but also as the second light guide lens 6 of the above embodiment on which the light of the second light source 4 is incident. Also, the light guide lens 5D is configured to function as the projection lens 2.

The light guide lens 5D has a first incidence surface portion 51D having a concave shape, a total reflection surface portion 55D, and an edge portion 53Da. The edge portion 53Da corresponds to the lower end edge 53*a* of the first light guide lens 5 (refer to FIG. 2) of the above embodiment. Also, the light guide lens 5D has a second incidence surface portion 61D corresponding to the second incidence surface portion 61 of the second light guide lens 6 (refer to FIG. 2) of the above embodiment, and an emission surface 21D corresponding to the emission surface 21 of the projection lens 2. The first light source 3 is attached on a base 7*e* in a state where the light-emitting surface thereof is located on a horizontal plane including the optical axis Ax and faces upward. The second light source 4 is attached on the base 7*e* in a state where the light-emitting surface thereof faces obliquely in a front and lower direction. The first light source 3 and the second light source 4 are disposed at the rear of the rear focus F of the projection lens 2. A parabolic reflector 92 is attached on the base 7*e* with covering the second light source 4.

According to the above configuration, it is possible to make a part of the light emitted from the second light source 4 be incident on the total reflection surface portion 55D of the light guide lens 5D, so that it is possible to suppress the dark part between the light distribution pattern PL for low beam and the additional light distribution pattern PA for high beam.

Fifth Modified Embodiment

Subsequently, a fifth modified embodiment of the first light guide lens 5 and the second light guide lens 6 of the above embodiment is described with reference to FIG. 14. Since the parts denoted with the same reference numerals as the above embodiment have the same functions, the overlapping descriptions thereof are omitted.

Figure 14:
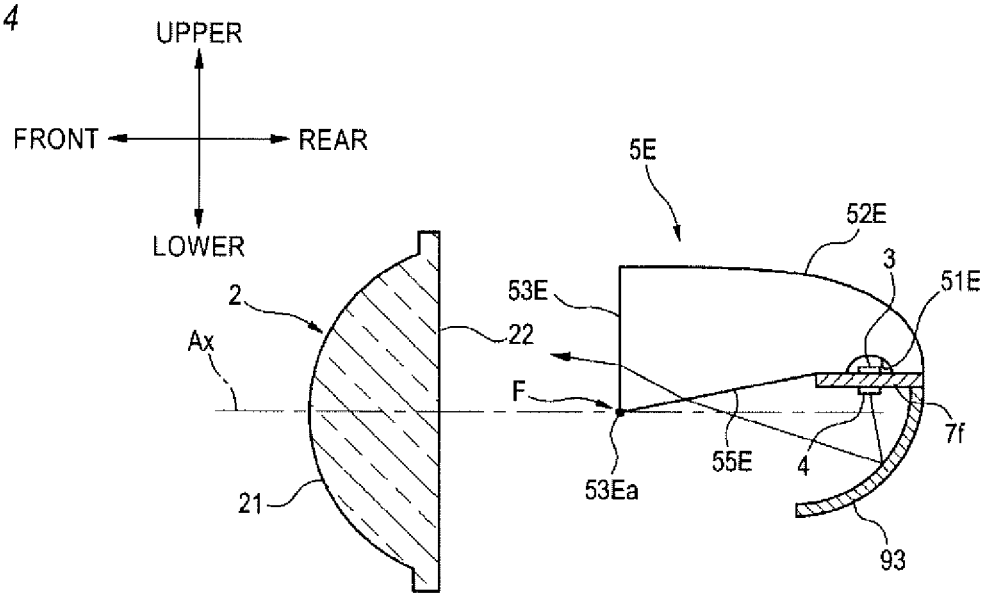
FIG. 14 is a longitudinal sectional view depicting a fifth modified embodiment of the light guide lens.

As shown in FIG. 14, a light guide lens 5E (an example of the first light guide member) of the fifth modified embodiment has a similar function to the first light guide lens 5 of the above embodiment. The light guide lens 5E has a first incidence surface portion 51E having a concave shape, an upper surface portion 52E provided to cover the first light source 3 from above, a lower end edge 53Ea, and a total reflection surface portion 55E.

The first light source 3 is attached on a substrate 7*f* in a state where the light-emitting surface thereof faces upward, and the second light source 4 is attached on the substrate 7*f* in a state where the light-emitting surface thereof faces downward. The first light source 3 and the second light source 4 is disposed above the optical axis Ax at the rear of the rear focus F of the projection lens 2. The upper surface portion 52E has been subjected to mirror treatment such as aluminum deposition. A parabolic reflector 93 is attached on the substrate 7*f* with covering the second light source 4.

According to the above configuration, since it is possible to make a part of the light emitted from the second light source 4 be incident on the total reflection surface portion 55E of the light guide lens 5E and be emitted from the first emission surface portion 53E of the light guide lens 5E toward the lamp front, it is possible to suppress the dark part between the light distribution pattern PL for low beam and the additional light distribution pattern PA for high beam.

Sixth Modified Embodiment

Subsequently, a sixth modified embodiment of the first light guide lens 5 and the second light guide lens 6 of the above embodiment is described with reference to FIG. 15. Since the parts denoted with the same reference numerals as the above embodiment have the same functions, the overlapping descriptions thereof are omitted.

Figure 15:
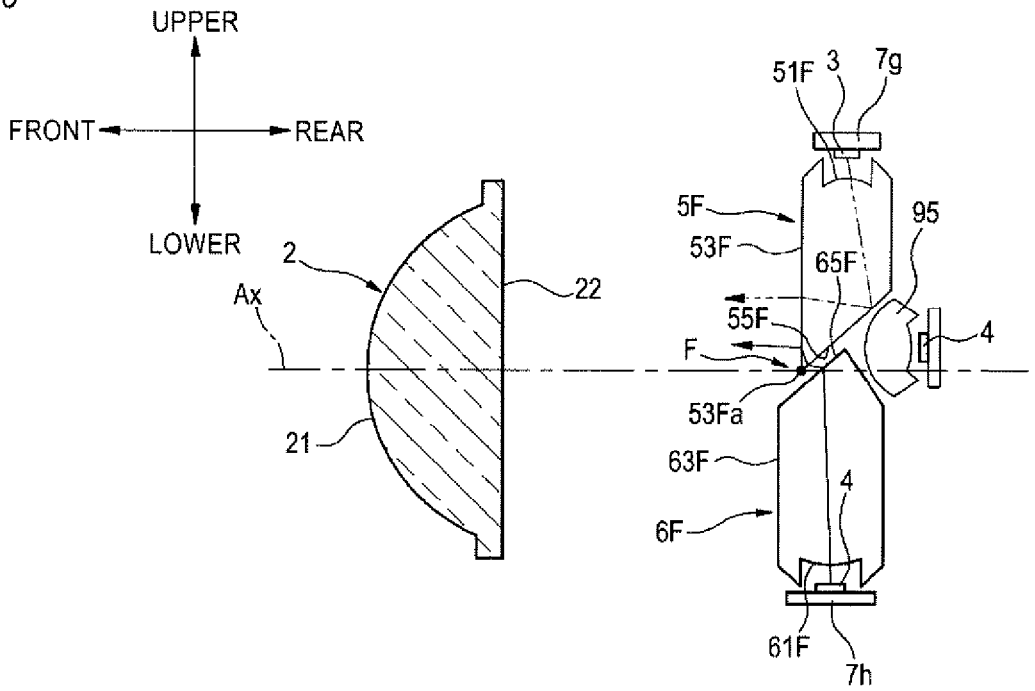
FIG. 15 is a longitudinal sectional view depicting a sixth modified embodiment of the light guide lens.

As shown in FIG. 15, a first light guide lens 5F (an example of the first light guide member) of the sixth modified embodiment has a first incidence surface portion 51F having a concave shape, a first emission surface portion 53F, a lower end edge 53Fa, and a total reflection surface portion 55F. A second light guide lens 6F (an example of the second light guide member) has a second incidence surface portion 61F having a concave shape, a second emission surface portion 63F, and a third emission surface portion 65F.

The first light source 3 is attached on a substrate 7*g* in a state where the light-emitting surface thereof faces downward. The second light source 4 is attached on a substrate 7*h* in a state where the light-emitting surface thereof faces upward. The first light source 3 is disposed above the optical axis Ax at the rear of the rear focus F of the projection lens 2. The second light source 4 is disposed below the optical axis Ax at the rear of the rear focus F of the projection lens 2. Also, the second light source 4 and a light guide lens 95 are disposed at the rear of the first light guide lens 5F and the second light guide lens 6F.

According to the above configuration, since it is possible to make a part of the light emitted from the second light source 4 be incident on the total reflection surface portion 55F of the light guide lens 5F and be emitted from the first emission surface portion 53F of the light guide lens 5F toward the lamp front, it is possible to suppress the dark part between the light distribution pattern PL for low beam and the additional light distribution pattern PA for high beam.

Seventh Modified Embodiment

Subsequently, a seventh modified embodiment of the first light guide lens 5 and the second light guide lens 6 of the above embodiment is described with reference to FIG. 16. Since the parts denoted with the same reference numerals as the above embodiment have the same functions, the overlapping descriptions thereof are omitted.

Figure 16:
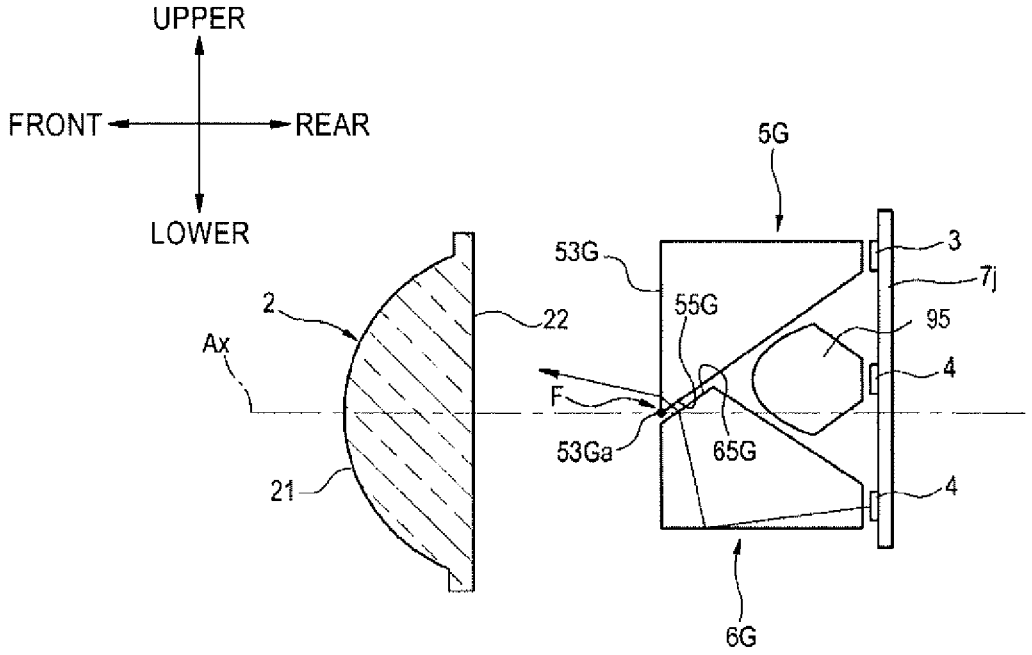
FIG. 16 is a longitudinal sectional view depicting a seventh modified embodiment of the light guide lens.

As shown in FIG. 16, the seventh modified embodiment is different from the configuration of the sixth modified embodiment (refer to FIG. 15), in that a first light guide lens 5G (an example of the first light guide member) and a second light guide lens 6G (an example of the second light guide member) are disposed at the rear of the respective lenses of the first light source 3 and the second light source 4. The first light source 3 and the second light source 4 are attached on a substrate 7*j* in a state where the light-emitting surfaces thereof face toward the lamp front.

Also in the above configuration, since it is possible to make a part of the light emitted from the second light source 4 be incident on the total reflection surface portion 55G of the light guide lens 5G and be emitted from the first emission surface portion 53G of the light guide lens 5G toward the lamp front, it is possible to suppress the dark part between the respective light distribution patterns.

In the meantime, the present invention is not limited to the above embodiments, and can be appropriately modified, improved and the like. In addition, the materials, shapes, sizes, numerical values, forms, number, arrangement places and the like of the respective constitutional elements of the embodiments are arbitrary and are not particularly limited inasmuch as it is possible to implement the present invention.

For example, the optical system is not limited to the projector type of the embodiments, and one or more embodiments of the present invention can be applied to the other optical systems such as a direct incidence type where the light from the light source is directly incident on the incidence surface of the projection lens, a parabola type where the light from the light source is emitted as parallel light toward the lamp front by using a reflector, and the like.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A vehicular lamp comprising:

a first light source configured to emit light for forming a first light distribution pattern;

a second light source configured to emit light for forming a second light distribution pattern that is added to the first light distribution pattern; and a first light guide member disposed to a lamp front relative to the first light source, wherein the first light guide member includes:

a first incidence surface portion on which the light emitted from the first light source is incident;

a total reflection surface portion by which at least a part of the light incident from the first incidence surface portion into the first light guide member is totally reflected; and a first emission surface portion from which the light totally reflected by the total reflection surface portion is emitted toward the lamp front, wherein at least a part of the light emitted from the second light source passes through the total reflection surface portion, passes through an inside of the first light guide member and is emitted from the first emission surface portion toward the lamp front, wherein the first light guide member includes an inclined surface that is inclined from the first light source-side toward the second light source-side as proceeding toward the lamp front, and wherein the total reflection surface portion is included in the inclined surface.

2. A vehicular lamp comprising:

a first light source configured to emit light for forming a first light distribution pattern;

a second light source configured to emit light for forming a second light distribution pattern that is added to the first light distribution pattern; and a first light guide member disposed to a lamp front relative to the first light source, wherein the first light guide member includes:

a first incidence surface portion on which the light emitted from the first light source is incident;

a total reflection surface portion by which at least a part of the light incident from the first incidence surface portion into the first light guide member is totally reflected; and a first emission surface portion from which the light totally reflected by the total reflection surface portion is emitted toward the lamp front, a second light guide member disposed to the lamp front relative to the second light source, wherein the second light guide member includes:

a second incidence surface portion on which the light emitted from the second light source is incident;

a second emission surface portion from which at least a part of the light incident from the second incidence surface portion into the second light guide member is emitted toward the lamp front; and a third emission surface portion from which at least a part of the light incident from the second incidence surface portion into the second light guide member is emitted toward the total reflection surface portion of the first light guide member, wherein at least a part of the light emitted from the second light source passes through the total reflection surface portion, passes through an inside of the first light guide member and is emitted from the first emission surface portion toward the lamp front, and wherein the total reflection surface portion of the first light guide member and the third emission surface portion of the second light guide member are disposed in parallel with a predetermined interval.

3. The vehicular lamp according to claim 1, further comprising:

a projection lens, wherein the first light source and the second light source are disposed at the rear of the projection lens, wherein the first light distribution pattern is a light distribution pattern for low beam, wherein the second light distribution pattern is an additional light distribution pattern for high beam, wherein the vehicular lamp is configured to selectively perform low beam irradiation and high beam irradiation, and wherein a boundary between the total reflection surface portion and the first emission surface portion is a cutoff line forming portion.

4. The vehicular lamp according to claim 2, further comprising:

a projection lens, wherein the first light source and the second light source are disposed at the rear of the projection lens, wherein the first light distribution pattern is a light distribution pattern for low beam, wherein the second light distribution pattern is an additional light distribution pattern for high beam, wherein the vehicular lamp is configured to selectively perform low beam irradiation and high beam irradiation, and wherein a boundary between the total reflection surface portion and the first emission surface portion is a cutoff line forming portion.

* * * * *